United States Patent [19]

Hayashi et al.

[11] Patent Number: 4,920,328

[45] Date of Patent: Apr. 24, 1990

[54] MATERIAL FOR RESISTOR BODY AND NON-LINEAR RESISTOR MADE THEREOF

[75] Inventors: Masahiko Hayashi, Kanagawa; Yoshiyuki Innami, Tokyo; Naoto Teshima, Shizuoka, all of Japan

[73] Assignee: Kabushiki Kaisha Meidensha, Tokyo, Japan

[21] Appl. No.: 270,084

[22] Filed: Nov. 14, 1988

[30] Foreign Application Priority Data

Nov. 12, 1987 [JP] Japan ..... 62-286155

[51] Int. Cl.[5] ..... H01C 7/10

[52] U.S. Cl. ..... 338/21; 252/519; 338/20

[58] Field of Search ..... 338/21; 252/519, 521; 361/127

[56] References Cited

U.S. PATENT DOCUMENTS 3,764,566 10/1973 Matsuoka et al. ..... 338/21 X
4,551,268 11/1985 Eda et al. ..... 338/21 X
4,724,416 2/1988 Nakata et al. ..... 338/21 X

FOREIGN PATENT DOCUMENTS 0097923 1/1984 European Pat. Off. .
0189087 7/1986 European Pat. Off. .
0241150 10/1987 European Pat. Off. .
0018099 6/1978 Japan ..... 338/21

OTHER PUBLICATIONS

Asokan et al., Studies of Microstructure and Density of Sintered Zn-O Based Non-Linear Resistors, Journal of Materials Science, 22 (1987), Jun., No. 6, London, Gr. Britain.

*Primary Examiner*—C. L. Albritton
*Attorney, Agent, or Firm*—Bachman & LaPointe

[57] ABSTRACT

An average size of ZnO particles which are three dimensionally connected and serve as primary component of a non-linear resistor, is adjusted to be within a range of 5 μm to 10 μm. The non-linear resistor is consisted of:

| | |
|---|---|
| $Bi_2O_3$ | 0.25 to 1.0 mole %; |
| $Sb_2O_3$ | 0.5 to 2.0 mole %; |
| $Co_2O_3$ | 0.25 to 1.0 mole %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mole %; and |
| ZnO | remainder for 100 mol %. |

14 Claims, 6 Drawing Sheets

FIRING TEMP. 1200°C
AVERAGE PARTICLE SIZE 13μm (x1000)

FIRING TEMP. 1060°C
AVERAGE PARTICLE SIZE 7μm (x1000)

MATERIAL FOR RESISTOR BODY AND NON-LINEAR RESISTOR MADE THEREOF

BACKGROUND OF THE INVENTION

1. Field of the Invention

The present invention relates generally to a non-linear resistor which is suitable for use in a lightning arrestor, surge absorber and so forth. More particularly, the invention relates to a material for non-linear resistor which has excellent electrical and mechanical characteristics.

2. Description of the Background Art

Non-linear resistors have known electric characteristics to non-linearly increase current according to increasing voltage and whereby lower voltage in non-linear fashion. Such non-linear resistor are known as useful element for absorbing extraordinarily high voltage. Therefore, the non-linear resistors have been used in a lightning arrestor, surge absorber and so forth.

One of typical composition of a material for forming the non-linear resistor contains zinc oxide as primary component. The non-linear resistor material is further composed of relatively small amount of oxides, such as bismuth trioxide ($Bi_2O_3$), cobalt oxide ($Co_2O_3$), manganese dioxide ($MnO_2$), antiminial oxide ($Sb_2O_3$) and so forth. The composite material is prepared by mixing the compositions set forth above and by crystalizing. The composite material is then shaped into a desired configuration and fired at a given temperature. Such non-linear resistor material has a three-dimensional structure having ZnO crystal (10°-cm) of 10 μm surrounded by high resistance intergranular layer of less than or equal to 0.1 μm thick, which intergranular layer contains $Bi_2O_3$ as primary component.

As is well known, the intergranular layer filling up gaps between ZnO crystals has an electric property or characteristics to substantially and non-linearly decrease resistance according to increasing of changed voltage. When composition is held unchanged, voltage/current characteristics of each unit of crystal-insulative intergranular layer-crystal is considered to be substantially constant.

As set forth, the non-linear resistors have considered useful because of excellent electric or non-linear voltage/current characteristics. However, the conventional non-linear resistors were not satisfactory in mechanical characteristics, such as compression strength, bending strength and so forth because interest was concentrated to electric characteristics. Because of lack of mechanical strength, application of the non-linear resistor has been limited.

SUMMARY OF THE INVENTION

Therefore, it is an object of the present invention to provide a material for forming a non-linear resistor which exhibits not only excellent voltage/current characteristics but also excellent mechanical characteristics.

Another object of the invention is to provide a non-linear resistor which has satisfactory voltage absorbing ability with sufficiently high mechanical strength.

In order to accomplish aforementioned and other objects, an average size of ZnO particles which are three dimensionally connected and serve as primary component of a non-linear resistor, is adjusted to be within a range of 5 μm to 10 μm.

The composition of the non-linear resistor, according to the present invention, is consisted of:

| | |
|---|---|
| $Bi_2O_3$ | 0.25 to 1.0 mol %; |
| $Sb_2O_3$ | 0.5 to 2.0 mol %; |
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %. |

According to one aspect of the invention, a non-linear resistor which includes a resistor body formed with a composite material composed of:

| | |
|---|---|
| $Bi_2O_3$ | 0.25 to 1.0 mol %; |
| $Sb_2O_3$ | 0.5 to 2.0 mol %; |
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %, and |

the resistor body including ZnO crystal, average particle size of which is adjusted within a range of 5 μm to 10 μm.

According to another aspect of the invention, a non-linear resistor which includes a resistor body, an insulating layer formed on the circumference of the resistor body, electrodes formed on both axial ends of the resistor body, the resistor body being formed with a composite material composed of:

| | |
|---|---|
| $Bi_2O_3$ | 0.25 to 1.0 mol %; |
| $Sb_2O_3$ | 0.5 to 2.0 mol %; |
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %, and |

the resistor body including ZnO crystal, average particle size of which is adjusted within a range of 5 μm to 10 μm.

Preferably, the resistor body is provided a compression strength approximately and higher than 70 kgf/mm$^2$. Also, the non-linear resistor has energy absorption capacity ratio approximately or higher than 1.00, and/or $\Delta V/V$ variation ratio approximately or lower than 1.0.

The preferred average particle size of ZnO crystal is in a range of 7 μm to 9 μm. Further preferably, the non-linear resistor is provided a compression strength approximately and higher than 80 kgf/mm$^2$, energy absorption capacity ratio approximately or higher than 1.10 and/or $\Delta V/V$ variation ratio approximately or lower than 0.8.

According to a further aspect of the invention, a process for producing a non-linear resistor comprising the steps of:

preparing composite material by mixing the following components

| | |
|---|---|
| $Bi_2O_3$ | 0.25 to 1.0 mol %; |
| $Sb_2O_3$ | 0.5 to 2.0 mol %; |

-continued

| | |
|---|---|
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %, |

forming the composite material into a desired configuration to form a shaped body; and performing firing of the shaped body at a controlled firing temperature, which firing temperature is adjusted to adjust average particle size of ZnO crystal growing during the firing process within a range of 5 μm to 10 μm.

The process further comprises the step performed in advance of firing step for pre-firing the shaped body at a temperature lower than the firing temperature. The pre-firing step is followed by a step of applying insulative material on the circumference of the shaped body.

On the other hand, the firing process is followed by a step of applying insulative material on the circumference of the shaped body. The insulative material applying step is further followed by a step of firing the insulative material to form an insulation layer on the circumference of the shaped resistor body and of heat treatment of the shaped resistor body.

According to a still further aspect of the invention, a process for producing a non-linear resistor comprising the steps of:

preparing composite material by mixing the following components

| | |
|---|---|
| $Bi_2O_3$ | 0.25 to 1.0 mol %; |
| $Sb_2O_3$ | 0.5 to 2.0 mol %; |
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %; |

forming the composite material into a desired configuration to form a shaped body; and performing firing of the shaped body at a controlled firing temperature, which firing temperature is adjusted at approximately or lower than 1150° C.

Preferably, the firing temperature is preferable at approximately or lower than 1100° C. and at approximately or higher than 1050° C.

Peforming the firing process at the firing temperature set forth above, appropriate density of ZnO crystal can be obtained in the sintered body. Furthermore, by appropriately controlling firing period, and firing temperature, high uniformity of grain distribution of ZnO crystal can be obtained.

BRIEF DESCRIPTION OF THE DRAWINGS

The present invention will be understood from the detailed description of the invention in terms of examples, which will be discussed hereafter with reference to the accompanying drawings, and which, however, should not be taken to limit the invention to the specific embodiments but for explanation and understanding only.

In the drawings.

DETAILED DESCRIPTION OF THE INVENTION

Figure 1:
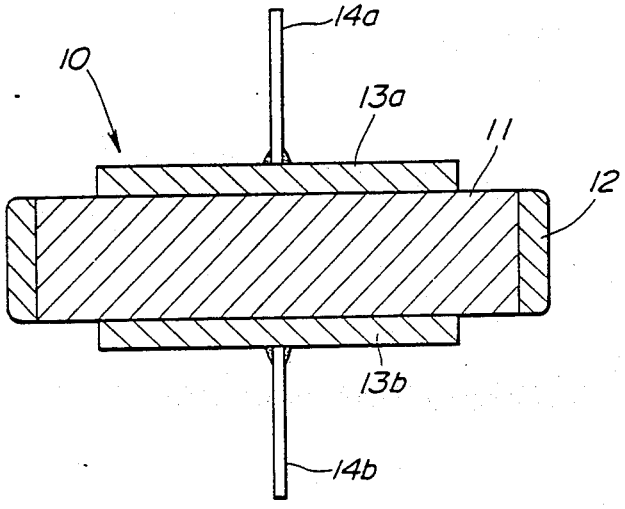
FIG. 1 is a cross-section of the preferred embodiment of a non-linear resistor according to the present invention, which non-linear resistor is composed of the preferred composition and preferred structure of material.

The present invention will be discussed herebelow in greater detail with reference to the accompanying drawings of the preferred embodiments. As shown in FIG. 1, the preferred embodiment of a non-linear resistor 10 according to the present invention, generally comprises a resistor body 11 and a circumferential insulation layer 12. The insulation layer 12 surrounds the outer circumference of the resistor body 11. On the both axial ends of the resistor body 11, electrodes 13*a* and 13*b* and electrode terminals 14*a* and 14*b* are provided for external connection.

Figure 2:
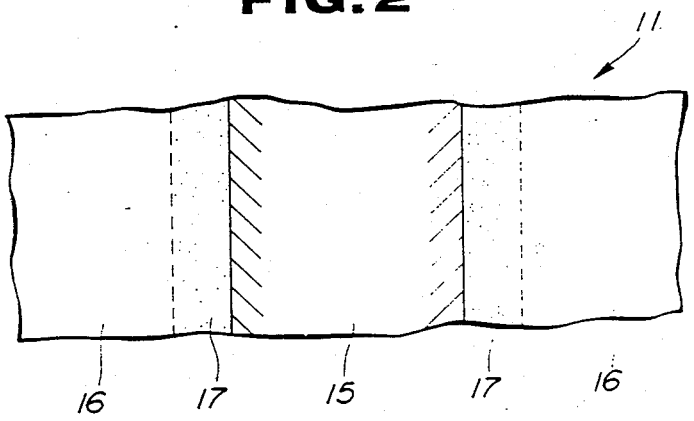
FIG. 2 is an enlarged section showing general structure of the non-linear resistor of FIG. 1.
Figure 3:
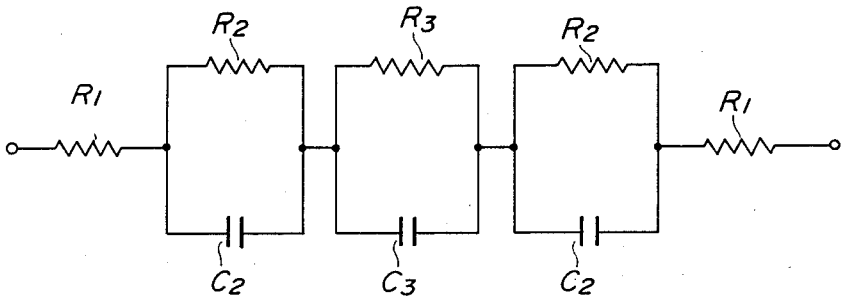
FIG. 3 is an equivalent circuit diagram of the non-linear resistor illustrated in FIG. 2.
Figure 4:
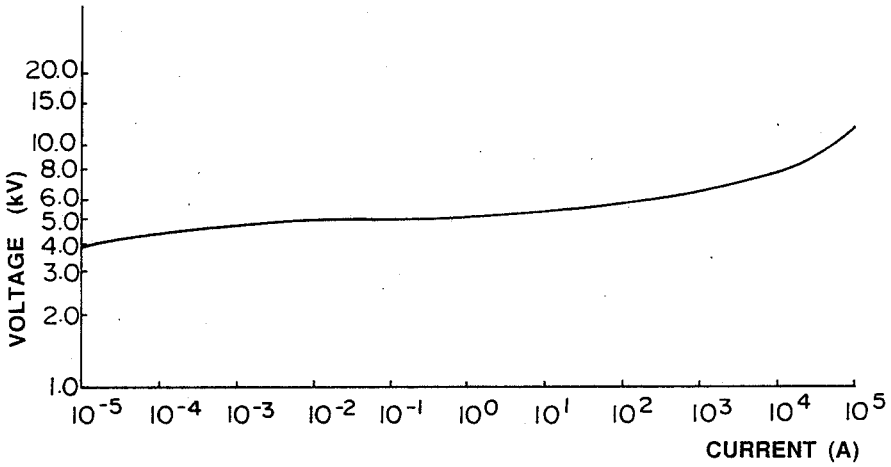
FIG. 4 is a chart showing current/voltage characteristics of the non-linear resistor.

The resistor body 11 is composed of a composition including zinc oxide (ZnO) as primary component. Generally, the resistor body 11 is provided non-linear characteristics for reducing resistance according to increasing of voltage and thus increasing current in non-linear fashion as shown in FIG. 4. The resistor body 11 is also provided high dielectric constant. As shown in FIG. 2, the resistor body 11 has a structure disposing an intergranular layer 15 between ZnO crystals 16. Between the ZnO crystal 16 is formed with a surface barrier layer 17. Such structure of resistor body 11 can be illustrated by an equivalent circuit diagram as shown in FIG. 3. In FIG. 3, $R_1$ represents resistance of ZnO crystals 16, 16, $R_2$ and $C_2$ represent resistance and capacity of the surface barrier layers 17, 17, and $R_3$ and $C_3$ represent resistance and capacity of the intergranular layer 15. The intergranular layer 15 is provided electric property for non-linearly reducing resistance $R_3$ according to increasing of the voltage. Therefore, with the structure interposing insulative layer between ZnO crystal, good non-linear characteristics as shown in FIG. 4 can be obtained.

Here, it should be appreciated that the voltage/current characteristics in the resistor body 11 will be held not significantly changed as long as composition of the components of the resistor body is held unchanged.

In the preferred embodiment, the resistor body 11 is composed of ZnO as primary component and metal oxides as additives to be added to the primary component, which metal oxides are composed of bismuth trioxide ($Bi_2O_3$), antimonial oxide ($Sb_2O_3$), cobalt oxide ($Co_2O_3$), manganese dioxide ($MnO_2$), chromium oxide ($Cr_2O_3$), nickel oxide (NiO) and silicon dioxide ($SiO_2$). The preferred composition of the materials set forth above is as follows:

| | |
|---|---|
| bismuth oxide ($Bi_2O_3$) | 0.25 to 1.0 mol %, |
| antimonial oxide ($Sb_2O_3$) | 0.5 to 2.0 mol %, |
| cobalt oxide ($Co_2O_3$) | 0.25 to 1.0 mol %, |
| manganese dioxide ($MnO_2$) | 0.25 to 1.0 mol %, |
| chromium oxide ($Cr_2O_3$) | 0.1 to 1.0 mol %, |
| nickel oxide (NiO) | 0.1 to 1.0 mol %, |
| silicon dioxide ($SiO_2$) | 0.25 to 2.0 mol %, and |
| zinc oxide (ZnO) | for remaining mol %. |

With the composite material set forth above, the resistor body 11 is formed and fired. During firing process, particle size of ZnO crystal is controlled to be 5 μm to 10 μm in average.

EXAMPLE 1

Composite material composed of ZnO 96 mol%, $Bi_2O_3$ 0.5 mol%, $Sb_2O_3$ 1.0 mol%, $Co_2O_3$ 0.5 mol%, $MnO_2$ 0.5 mol%, $Cr_2O_3$ 0.5 mol%, NiO 1.0 mol% and $SiO_2$ 0.5 mol% was prepared. With the prepared material, resistor body in a size of 40 mm in diameter and 10 mm in thickness was formed. The formed body was subject pre-firing at 900° C. for two hours. The insulative material, such as glass, is applied on the circumferential surface of the pre-fired body. The pre-fired body with the insulative material layer on the circumference was subject firing process. Firing process was performed at a temperature in a range of 1050° C. to 1250° C. for ten hours to twenty hours. For the circumference of the fired body, insulative material is again applied. Thereafter, firing of the insulative material and heat treatment of the resistor body were simultaneously performed at a temperature in a range of 500° C. to 700° C. for two hours to ten hours. The axial ends of the resistor body 11 thus prepared was grinded and electrodes 13*a* and 13*b* are formed by spray coating of electrode material, such as aluminium.

In the experiments, two samples were produced at different firing temperature. One of the sample was produced through the firing process performed at a firing temperature of 1200° C. This sample will be hereafter referred to as "sample I". The other sample was produced through the firing process performed at a firing temperature of 1060° C. This sample will be hereafter referred to as "sample II".

Figure 5A:
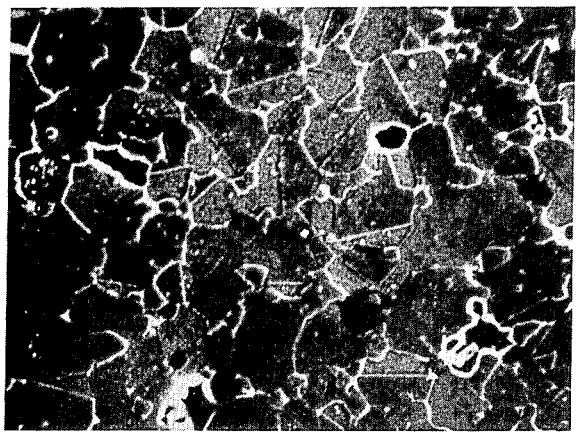
FIGS. 5(A) and 5(B) are scanning microphotography of the first embodiment of non-linear resistor composed of zinc oxide and metal oxides.
Figure 5B:
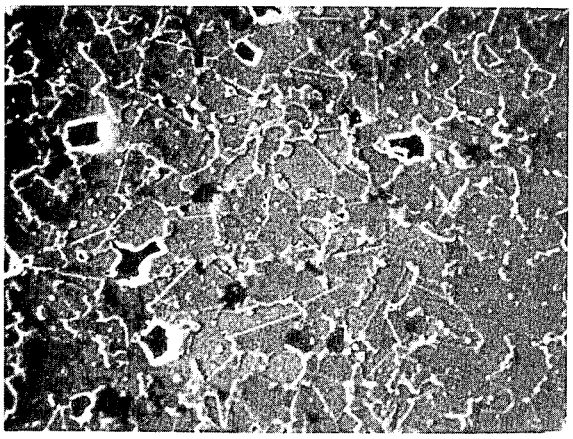

FIGS. 5(A) and 5(B) are scanning electromicrographies showing internal structure of the smaples I and II. These electromicrographies show the structure in magnification of 1000. FIG. 5(A) shows the structure of sample I which was prepared at firing temperature was 1200° C. In this case, the particle size of the ZnO crystal was 13 μm. On the other hand, FIG. 5(B) shows the structure of sample II which was prepared at the firing temperature was 1060° C. In this case, the particle size of the ZnO crystal was 7 μm.

EXAMPLE 2

Composite material composed of ZnO 96.5 mol%, $Bi_2O_3$ 0.7 mol%, $Sb_2O_3$ 0.5 mol%, $Co_2O_3$ 0.5 mol%, $MnO_2$ 0.5 mol%, $Cr_2O_3$ 0.5 mol%, NiO 1.0 mol% and $SiO_2$ 0.5 mol% was prepared. The components were mixed and subject the processes of forming, pre-firing, firing, heat treatment and formation of electrode in the same manner as set forth with respect to the former example.

Figure 6:
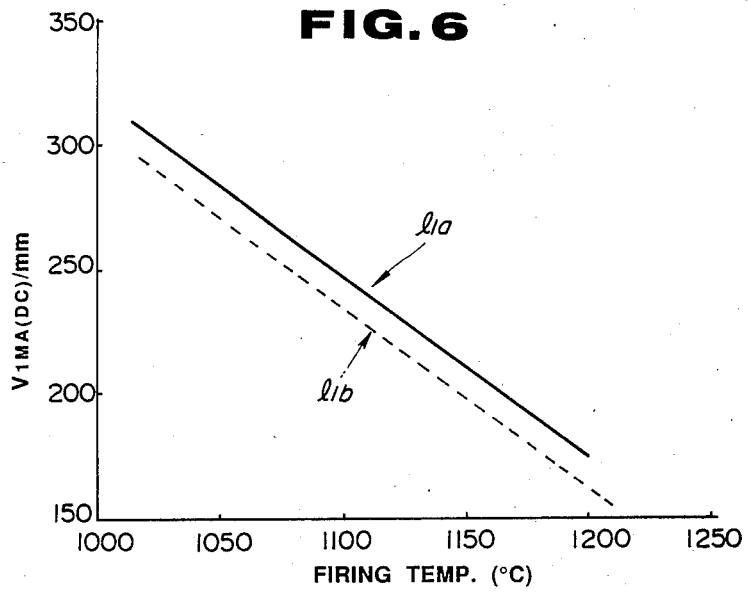
FIG. 6 is a chart showing relationship between heating temperature and $V_{1mA}$(DC)/mm in the first and second embodiments of the non-linear resistors.

Through the examples 1 and 2, relationship between the firing temperature (°C.) and $V_{1mA}$/mm was checked. The results are shown in FIG. 6. In FIG. 6, line $l_{1a}$ shows variation of $V_{1mA}$/mm in relation to the firing temperature in the example 1, and line $l_{1b}$ shows variation of $V_{1mA}$/mm in relation to the firing temperature in the example 2. As will be seen herefrom, in either case, $V_{1mA}$/mm linearly proportional to variation of the firing temperature.

Figure 7:
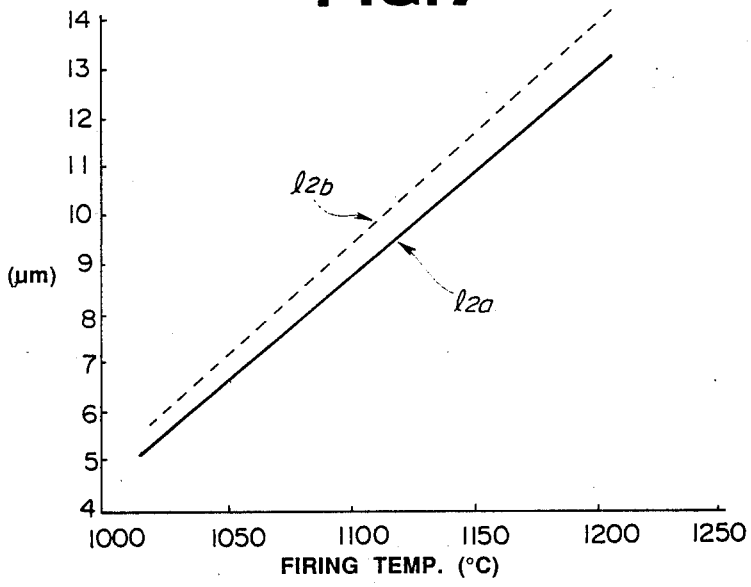
FIG. 7 is a chart showing relationship between heating temperature and average particle size of zinc oxide in the first and second embodiment of the non-linear resistors.

Also, through the experiments in the examples 1 and 2, relationship between average particle size of ZnO crystal which grows during firing process, and the firing temperature was checked. The results are shown in FIG. 7. In FIG. 7, line $l_{2a}$ shows variation of the average particle size of ZnO crystal in the example 1 and line $l_{2b}$ shows variation of the average particle size of ZnO crystal in the example 2. As seen herefrom, the average particle size of ZnO linearly varies according to variation of the firing temperature.

Figure 8:
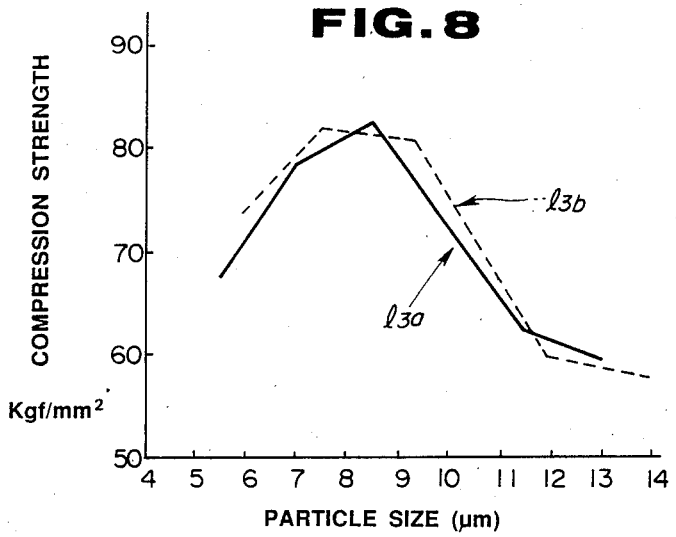
FIG. 8 is a chart showing relationship between the particle size of zinc oxide crystal in the first and second embodiment of the non-linear resistors, and compression strength of the non-linear resistors.

With respect to samples produced through the examples 1 and 2 by varying the firing temperature and thereby varying the average particle size of ZnO crystal, test for checking compression strength (kgf/mm$^2$) was performed. The results of the compression test is shown in FIG. 8. In FIG. 8, line $l_{3a}$ shows variation of compression strength in the samples produced in the example 1 and line $l_{3b}$ shows variation of compression strength in the samples produced in the example 2. As will be seen from the results of compression test in FIG. 8, satisfactorily high compression strength can be obtained at a ZnO crystal average particle size range smaller than 10 μm in either case. Particularly, when the ZnO crystal average particle size is in a range of 7 μm to 9 μm, the compression strength becomes maximum.

Figure 9:
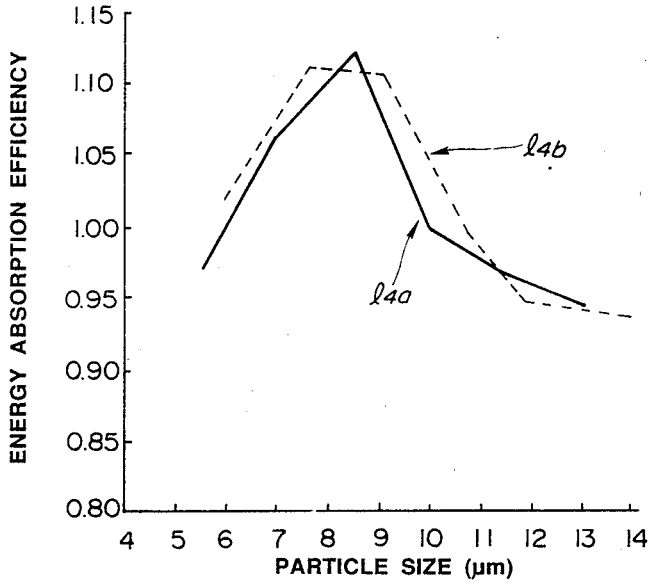
FIG. 9 is a chart showing relationship between an average particle sizes of the zinc oxide crystal in the first and second embodiment of the non-linear resistor and energy absorption ratio.
Figure 10:
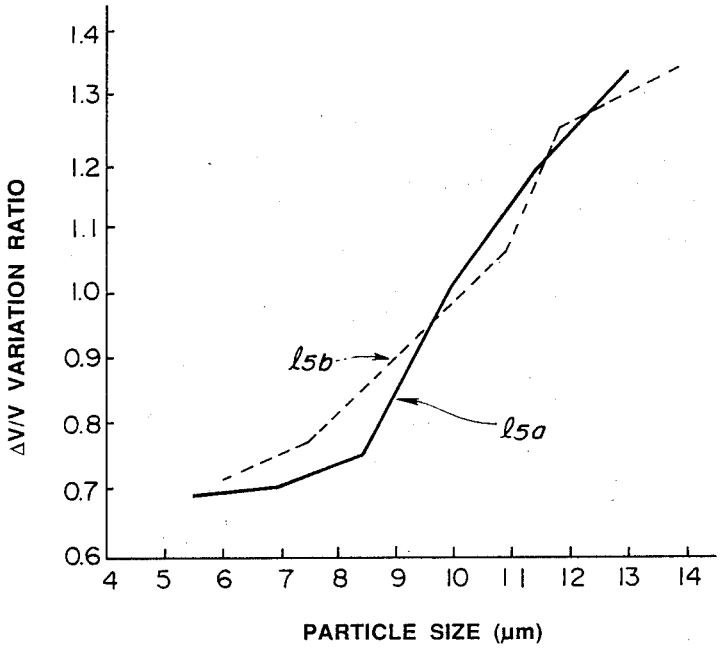
FIG. 10 is a chart showing relationship between an average particle sizes of the zinc oxide crystal in the first and second embodiment of the non-linear resistor and variation ratio of ΔV/V.

Additionally, energy absorption ratio was checked with respect to various samples prepared through the examples 1 and 2. Results of energy absorption tests is shown in FIG. 9. As will be seen from FIG. 9, energy absorption ratio varies in similar characteristics to compression strength variation characteristics. Therefore, from the view point of energy absorption, the average size of the ZnO crystal is preferred in a range smaller than 10 μm.

From FIGS. 8 and 9, the preferred average particle size range of the ZnO crystal can be appreciated in a range of 5 μm to 10 μm.

Another test for checking ΔV/V was further performed by applying impulse of 40 kA(4×10 μS wave) to the samples. The impulse was applied twice for each sample. The results is shown in FIG. 9. In FIG. 9, line $l_{4a}$ shows variation of ΔV/V in the samples prepared through the example 1, and line $l_{4b}$ shows variation of ΔV/V in the samples prepared through the example 2. From this, it was found that the smaller average particle size of ZnO crystal has better $V_{1mA}$ variation ratio. Furthermore, better limited voltage ratio which is ratio of terminal voltage upon application of impulse of 10 kA versus terminal voltage upon applying DC current of 1 mA, when the average particle size of the ZnO crystal is smaller.

In the samples produced in the example 1, the bending strength of the sample having the average particle size of the ZnO crystal of 10 μm was 11.5 kgf/mm$^2$. The bending strength is increased to 13.2 kgf/m$^2$ when the average particle size of ZnO crystal was 8.5 μm.

From these results, it will be appreciated that the non-linear resistor provided according to the present invention can provide not only good electric characteristics but also good mechanical characteristics. This may sweep up the problem in the conventional non-linear resistor to expand the field of use and make application to various systems easier.

Therefore, the invention fulfills all of the objects and advantages sought therefore.

What is claimed is:

1. A non-linear resistor which includes a resistor body formed with a composite material composed of:

| | |
|---|---|
| $Bi_2O_3$ | 0.25 to 1.0 mol %; |
| $Sb_2O_3$ | 0.5 to 2.0 mol %; |
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %, and |

said resistor body including ZnO crystal, average particle size of which is adjusted within a range of 5 μm to 10 μm.

2. A non-linear resistor as set forth in claim 1, wherein the average particle size of ZnO crystal is further preferably in a range of 7 μm to 9 μm.

3. A non-linear resistor which includes a resistor body, an insulating layer formed on the circumference of said resistor body, electrodes formed on both axial ends of said resistor body, said resistor body being formed with a composite material composed of:

-continued

| | |
|---|---|
| $Bi_2O_3$ | 0.25 to 1.0 mol %; |
| $Sb_2O_3$ | 0.5 to 2.0 mol %; |
| $Co_2O_3$ | 0.25 to 1.0 mol %; |
| $MnO_2$ | 0.25 to 1.0 mol %; |
| $Cr_2O_3$ | 0.1 to 1.0 mol %; |
| $NiO_2$ | 0.1 to 1.0 mol %; |
| $SiO_2$ | 0.25 to 2.0 mol %; and |
| ZnO | remainder for 100 mol %, and |

said resistor body including ZnO crystal, average particle size of which is adjusted within a range of 5 μm to 10 μm.

4. A non-linear resistor as set forth in claim 3, which has a compression strength approximately and higher than 70 kgf/mm$^2$.

5. A non-linear resistor as set forth in claim 3, which has energy absorption capacity ratio approximately or higher than 1.00.

6. A non-linear resistor as set forth in claim 3, which has ΔV/V variation ratio approximately or lower than 1.0.

7. A non-linear resistor as set forth in claim 4, which has energy absorption capacity ratio approximately or higher than 1.00.

8. A non-linear resistor as set forth in claim 4, which has ΔV/V variation ratio approximately or lower than 1.0.

9. A non-linear resistor as set forth in claim 3, wherein the average particle size of ZnO crystal is further preferably in a range of 7 μm to 9 μm.

10. A non-linear resistor as set forth in claim 9, which has a compression strength approximately and higher than 80 kgf/mm$^2$.

11. A non-linear resistor as set forth in claim 9, which has energy absorption capacity ratio approximately or higher than 1.10.

12. A non-linear resistor as set forth in claim 9, which has ΔV/V variation ratio approximately or lower than 0.8.

13. A non-linear resistor as set forth in claim 10, which has energy absorption capacity ratio approximately or higher than 1.10.

14. A non-linear resistor as set forth in claim 13, which has ΔV/V variation ratio approximately or lower than 0.8.

* * * * *